US007841924B2

(12) United States Patent
Wan

(10) Patent No.: US 7,841,924 B2
(45) Date of Patent: Nov. 30, 2010

(54) BRASSIERE CUP UNDERWIRE

(75) Inventor: Ho Yau Wan, Kowloon (CN)

(73) Assignee: Top Form (B.V.I.) Limited, Tortola (VG)

( * ) Notice: Subject to any disclaimer, the term of this patent is extended or adjusted under 35 U.S.C. 154(b) by 0 days.

(21) Appl. No.: 11/707,486

(22) Filed: Feb. 16, 2007

(65) Prior Publication Data

US 2008/0076326 A1 Mar. 27, 2008

(30) Foreign Application Priority Data

Sep. 21, 2006 (HK) ..... 06110574.7

(51) Int. Cl.
*A41C 1/14* (2006.01)
*A41C 3/10* (2006.01)

(52) U.S. Cl. ..... 450/41; 450/45

(58) Field of Classification Search ..... 450/41, 450/45, 47, 48, 51, 52; 2/251, 260, 260.1
See application file for complete search history.

(56) References Cited

U.S. PATENT DOCUMENTS

| | | | | |
|---|---|---|---|---|
| 2,782,417 | A * | 2/1957 | Magidson | 450/41 |
| 3,114,374 | A * | 12/1963 | Chalfin et al. | 450/41 |
| 5,141,470 | A * | 8/1992 | Morgan et al. | 450/52 |
| 5,472,366 | A * | 12/1995 | Moore | 450/41 |
| 6,346,028 | B1 * | 2/2002 | Fildan et al. | 450/41 |
| 6,447,365 | B1 * | 9/2002 | Powell et al. | 450/41 |
| 6,811,464 | B2 * | 11/2004 | Li | 450/57 |
| 6,824,444 | B2 * | 11/2004 | Huang | 450/57 |
| 6,857,933 | B2 * | 2/2005 | Horta et al. | 450/41 |

* cited by examiner

*Primary Examiner*—Gloria Hale
(74) *Attorney, Agent, or Firm*—Alix, Yale & Ristas, LLP

(57) ABSTRACT

A brassiere cup underwire includes a flexible plastics strip of varied crosswise dimension along its length so that the degree of support offered by the underwire varies throughout its length.

7 Claims, 5 Drawing Sheets

BRASSIERE CUP UNDERWIRE

BACKGROUND OF THE INVENTION

The present invention relates to brassieres. The invention more particularly, although not exclusively relates to a brassiere having specially formed underwires and/or other support features.

Known brassieres have a stiff metallic underwire sewn into the bottom of each cup. Such underwires provide an adequate level of support but are uncomfortable, unsightly and can protrude from the brassiere after a time of use. Such metallic underwires are also of constant cross-section and stiffness throughout their length and therefore do not provide a desired level of variable support throughout their length.

OBJECTS OF THE INVENTION

It is an object of the present invention to overcome or substantially ameliorate the above disadvantages and/or more generally to provide an improved brassiere and brassiere cup underwire and/or other support feature.

DISCLOSURE OF THE INVENTION

There is disclosed herein a brassiere cup underwire comprising a plastics strip of varied flexibility along its length. Such an underwire will provide variable "firmness" or "hardness" along its length and thereby provide varied degrees of support therealong.

Preferably, the plastics strip is of varied crosswise dimension along its length.

Preferably, said dimension graduates from a minimum at one end of the underwire to a maximum at the other end of the underwire.

Preferably, the underwire is formed as a moulding.

The underwire can comprise different plastics materials along its length, with materials chosen for their degree of flexibility suitable for a particular position therealong.

There is further disclosed herein a brassiere cup having the above-disclosed underwire located in an edge region thereof.

Preferably, the underwire is located between layers of material from which the cup is formed.

BRIEF DESCRIPTION OF THE DRAWINGS

Preferred forms of the present invention will now be described by way of example with reference to the accompanying drawings, wherein.

DESCRIPTION OF THE PREFERRED EMBODIMENT

Figure 1:
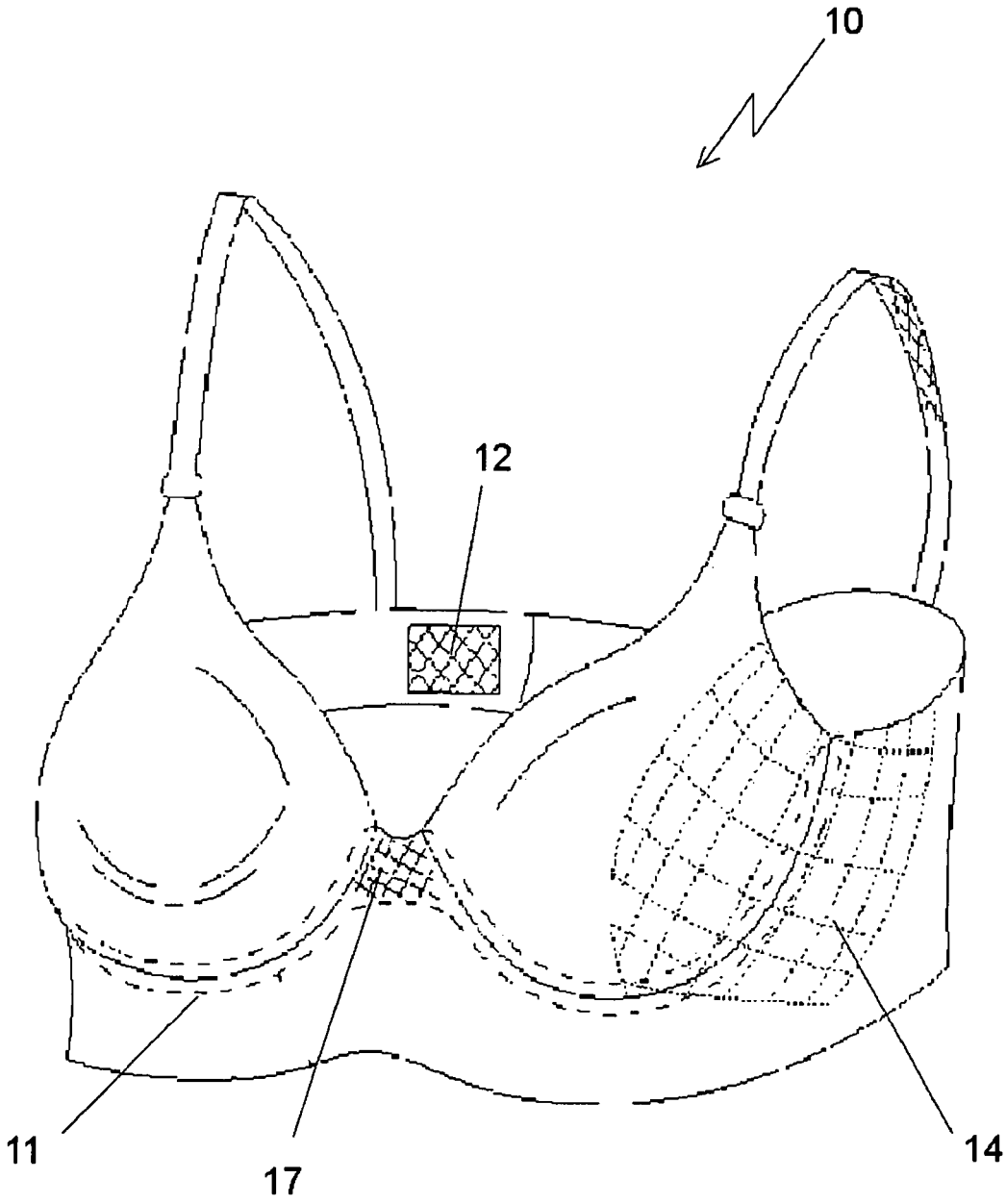
FIG. 1 is a schematic perspective illustration of a brassiere.

In FIG. 1 of the accompanying drawings there is depicted schematically a brassiere 10 having a pair of breast cups, a pair of shoulder straps, a front band, a pair of underwires 11, and a back strap which is an extension of the front band. The back strap is connected by hook and loop fasteners 12. The brassiere also includes a pair of uplifting panels 14 and a reinforced central sternum area 17 between the cups.

Figure 4:
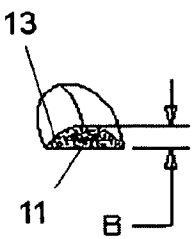
FIG. 4 is a schematic cross-sectional end elevation of a thin end portion of the underwire of FIG. 2.
Figure 2:
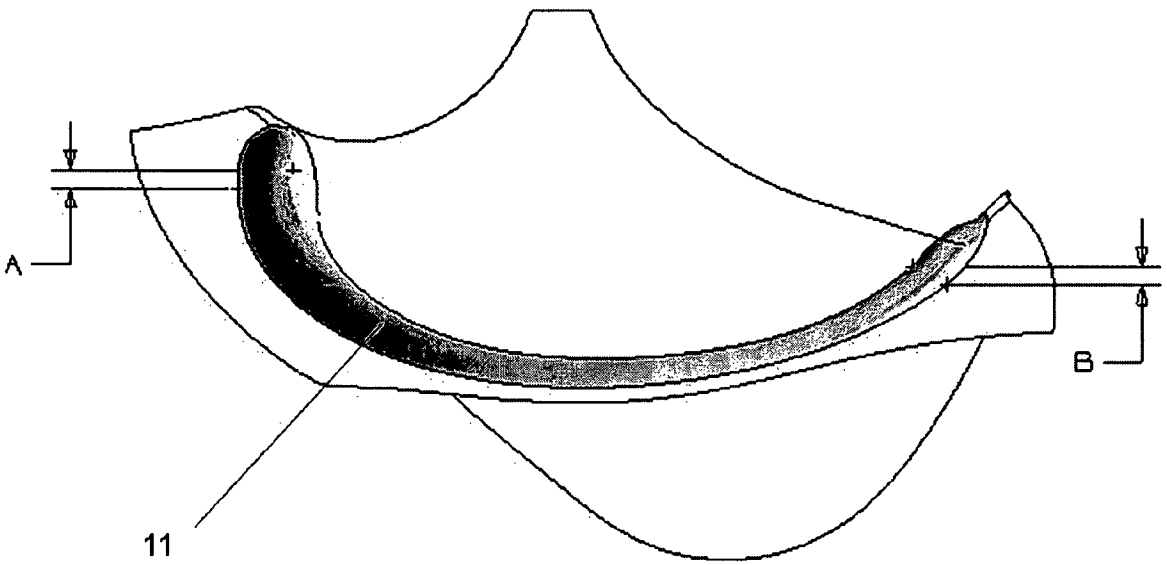
FIG. 2 is a schematic elevation of a special underwire.
Figure 3:
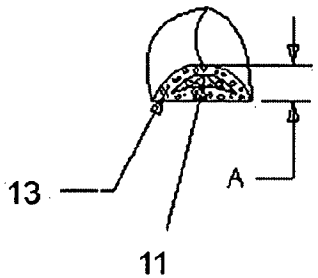
FIG. 3 is a schematic cross-sectional end elevation of a thick end portion of the underwire of FIG. 2.

An underwire 11 is shown in FIGS. 2 to 4. Each underwire comprises a flat strip of flexible foam or plastics material which varies in thickness from a maximum as shown at A at one end of the underwire to a minimum as shown at B at the other end of the underwire. The thickness of the underwire varies gradually between A and B. The underwire 11 is surrounded by foam 13 as shown in FIGS. 3 and 4. The foam and underwire are typically moulded into the bottom edge region of the brassiere cup during the manufacturing process. As an alternative, the underwire could be positioned and held in place with respect to the brassiere cup for subsequent lamination of the underwires into the brassiere cup itself.

One end of the underwire (typically the end closest to the wearer's shoulder) is the thickest, whereas the other end of the underwire (typically the end nearest the wearer's sternum) is the thinnest. This provides a gradual reduction in stiffness of the underwire along its length. In order to finely tune the degree of support and comfort along the length of the underwire, differing materials and material thicknesses may be adopted. Indeed different configurations might be required for different cup sizes to suit the anatomy of different women.

Figure 6:
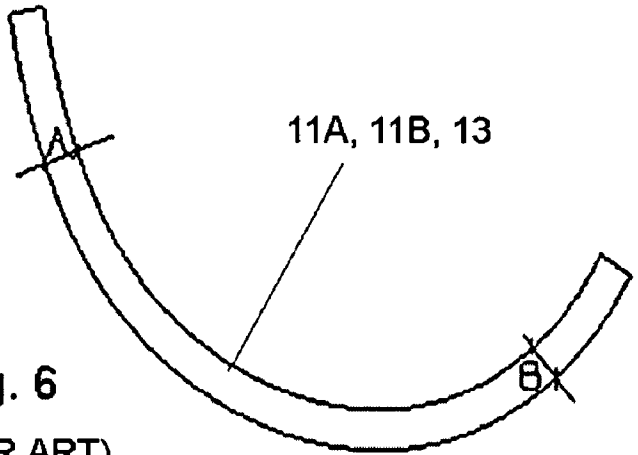
Fig. 6 (PRIOR ART)
FIG. 6 is a schematic elevation of the prior art underwire of FIG. 5.
Figure 8:
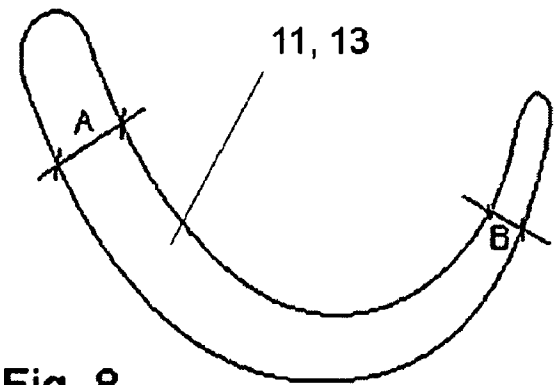
FIG. 8 is a schematic elevation of the underwire of FIG. 7.
Figure 5:
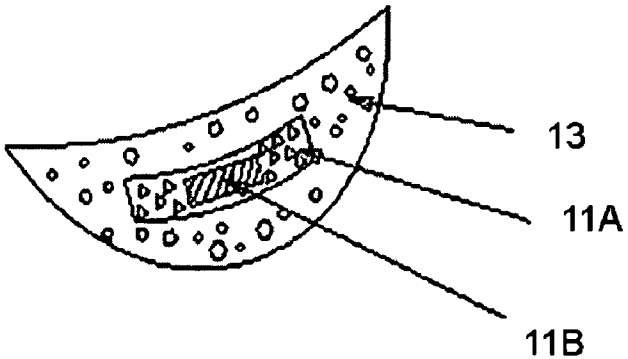
Fig. 5 (PRIOR ART)
FIG. 5 is a schematic cross-sectional elevation of a prior art underwire.
Figure 7:
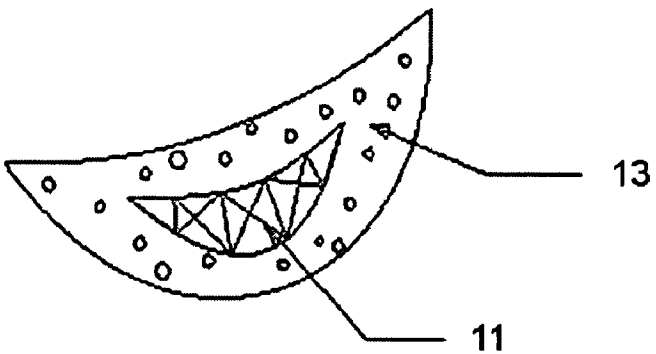
FIG. 7 is a schematic cross-sectional elevation of the underwire of FIG. 2.

FIGS. 5 and 6 are included for comparison and show a typical prior art underwire structure. In the prior art, the underwire is of constant cross-section throughout its length and includes a central metallic wire 11B surrounded by a metallic wire loop 11A. These two parts are encased in foam 13. Although the foam 13 provides some degree of protection from the hard metallic core, the stiffness of the wire is constant throughout its length due to the constant thicknesses shown at A and B which are equal. Discomfort thereby results. FIGS. 7 and 8 on the other hand show an underwire made in accordance with the present invention and in which the plastics underwire 11 is also surrounded by foam 13, but as shown in FIG. 8, the thickness or depth of the underwire diminishes gradually from one end to the other. In this case the dimension A is greater than B.

The underwire 11 is typically formed in and located at a transition position between the cup and the front band of the brassiere. The underwire would be orientated with its flatter side facing the body of the wearer so that the convex side of the underwire faces outwardly away from the body. The brassiere cup might be formed as a lamination of foam plastics material—between layers of which the underwire 11 is located.

Figure 9:
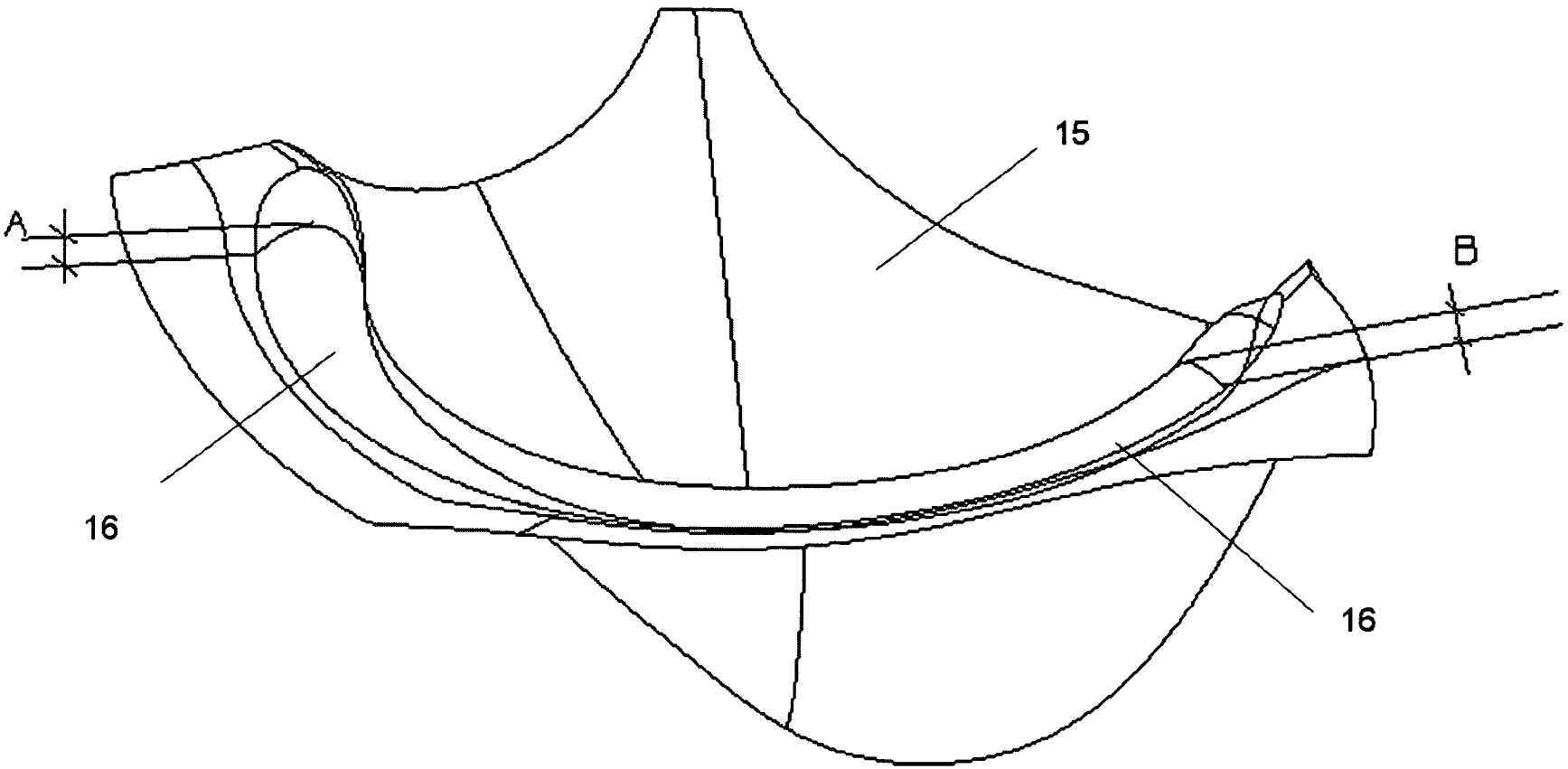
FIG. 9 is a schematic perspective illustration of a mould used to form a brassiere cup with an underwire of variable depth along its length.

FIG. 9 shows a mould 15 in which a brassiere cup and underwire are moulded. The mould comprises a trough 16 defining the overall shape of the underwire 11. The trough 16 is deep at A and shallow at B. The desired layers of fabric and foam material are set down upon the mould 15 and extend into the trough. Granular plastics material is then placed over the material which extends into the trough 16. The deep end of the trough accepts more granular material than the shallow end.

Either during or after the moulding process in which other layers of foam and fabric material are pressed against the granular plastics material to encase it, heat sufficient to melt/soften the plastics material and pressure are applied so that the granules of plastic material meld into a continuous strip of variable depth along its length.

Figure 10:
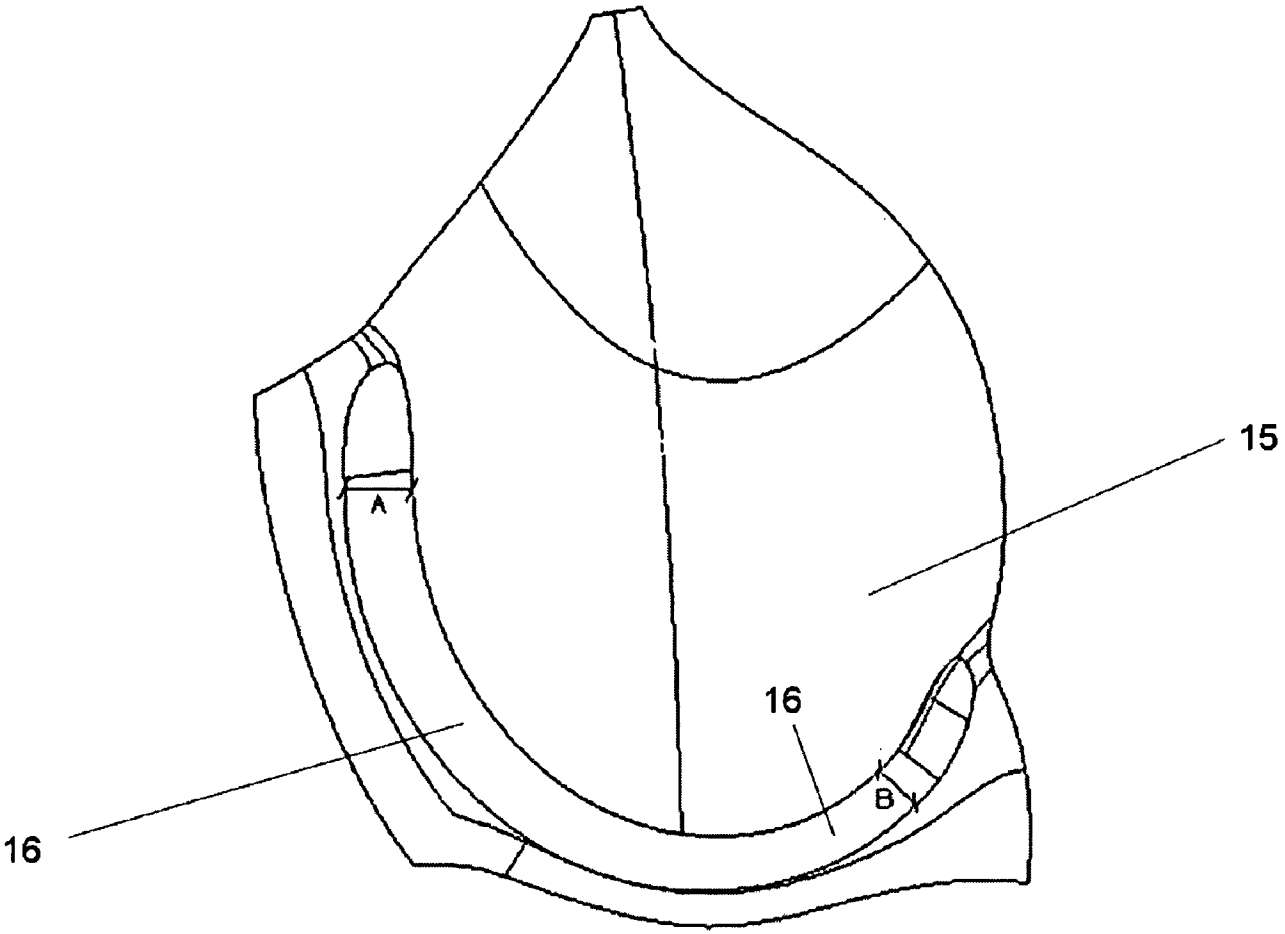
FIG. 10 is a schematic perspective illustration of a mould used to form a brassiere cup with an underwire of variable width along its length.

FIG. 10 shows a different mould 15 in which a brassiere cup and underwire are moulded. The mould comprises a trough 16 defining the overall shape of the underwire 11. The trough 16 is wide at A and narrow at B. The desired layers of fabric and foam material are set down upon the mould 15 and extend into the trough. Granular plastics material is then placed over the material which extends into the trough 16. The wide end of the trough accepts more granular material than the narrow end. Either during or after the moulding process in which other layers of foam and fabric material are pressed against the granular plastics material to encase it, heat sufficient to melt/soften the plastics material and pressure are applied so that the granules of plastic material meld into a continuous strip of variable width along its length.

Features 12, 14 and 17 shown in FIG. 1 are examples of other parts of a brassiere that can comprise reinforcing and support panels formed by practically the same method as described for forming the underwire. These are areas of the brassiere that would typically require extra strength and provide additional support. For example, it might be desirable to incorporate a reinforcing pad behind typical hook and loop fasteners 12. This would enable the user to more positively secure the hook fasteners to the loop fasteners. At the sternum region 17 between the brassiere cups, extra reinforcing might be desired. Furthermore, special uplifting panels 14 could be provided at the outer edge regions of each cup. Each of these features might be provided by a mould having a cavity to receive granular plastics material to be heat-melded in a manner similar to that described. Indeed, the uplifting panels 14 and sternum reinforcing area 17 could be formed integrally with the underwires as extensions thereof.

It should be appreciated that modifications and alterations obvious to those skilled in the art are not to be considered as beyond the scope of the present invention. For example, rather than using granular plastics material in the method of forming the underwire, continuous variable-length strips of plastics material could be laid one upon another in stepwise manner such that thickness of the material varies from one end to the other. These layers could then be melded together upon the application of heat and pressure to remove any steps between the layers.

The invention claimed is:

1. A brassiere cup support for placement in a fabric brassiere cup having a lower edge, said brassiere cup support comprising:

a two component plastic strip having a length;

said two component plastic strip including a plastic underwire surrounded by foam molded about said underwire;

said plastic underwire having a gradual change in flexibility along said length;

said strip conforming to the lower edge of the brassiere cup; and said plastic underwire being molded by heat-melting and encased in said foam along its length.

2. The underwire of claim 1, wherein the plastic underwire has a length and is of varied crosswise dimension along said length.

3. The underwire of claim 2, wherein said crosswise dimension graduates from a minimum at one end of the underwire to a maximum at the other end of the underwire.

4. A brassiere cup formed of a fabric material and having a lower edge region and a brassiere cup support located in said cup lower edge region;

said support comprising:

a two component plastic strip having a length;

said two component plastic strip including a plastic underwire surrounded by foam molded about said underwire;

said plastic underwire having a gradual change in flexibility along its length;

said strip conforming to the lower edge region of the brassiere cup; and said plastic underwire being molded by heat-melting and encased in said foam along its length and between layers of said fabric material.

5. A brassiere comprising a pair of the brassiere cups of claim 4.

6. The brassiere cup of claim 4 wherein the plastic underwire has a length, said underwire having a varied crosswise dimension along said length.

7. The brassiere cup of claim 6 wherein said crosswise dimension graduates from a minimum at one end of the underwire to a maximum at the other end of the underwire.

* * * * *